United States Patent [19]

Matsuda

[11] Patent Number: 4,974,305

[45] Date of Patent: Dec. 4, 1990

[54] METHOD OF ATTACHING FASTENER ELEMENTS TO FASTENER TAPE

[75] Inventor: Yasuhiko Matsuda, Toyama, Japan

[73] Assignee: Yoshida Kogyo K. K., Tokyo, Japan

[21] Appl. No.: 456,381

[22] Filed: Dec. 26, 1989

[30] Foreign Application Priority Data

Dec. 27, 1988 [JP] Japan ..... 63-330587

[51] Int. Cl.[5] ..... B21D 53/50

[52] U.S. Cl. ..... 29/408; 29/769

[58] Field of Search ..... 29/408, 410, 769

[56] References Cited

U.S. PATENT DOCUMENTS

| | | | |
|---|---|---|---|
| 1,903,659 | 4/1938 | Smith . | |
| 2,070,902 | 2/1937 | Hinman . | |
| 2,087,461 | 7/1937 | Wittenberg . | |
| 2,125,707 | 8/1938 | Anderson . | |
| 2,141,200 | 12/1938 | Sundback | 29/769 |
| 2,217,121 | 10/1940 | Lindner | 29/769 |
| 2,244,667 | 6/1941 | Banning . | |
| 2,321,951 | 6/1943 | Süsskind | 29/769 |
| 2,335,034 | 11/1943 | Winterhalter | 29/769 |

FOREIGN PATENT DOCUMENTS

| | | | |
|---|---|---|---|
| 452331 | 11/1948 | Canada | 29/408 |
| 864076 | 4/1941 | France . | |
| 338030 | 4/1930 | Japan . | |
| 398816 | 9/1933 | United Kingdom | 29/769 |
| 621270 | 4/1949 | United Kingdom . | |

*Primary Examiner*—P. W. Echols

*Attorney, Agent, or Firm*—Hill, Van Santen, Steadman & Simpson

[57] ABSTRACT

A fastener tape is intermittently transferred under tension longitudinally thereof. A discrete fastener element is fed to astraddle one longitudinal beaded edge of the fastener tape. Then, the coupling head of the fastener element is pressed at its both sides substantially perpendicularly to the plane of the fastener tape to bring the fastener element into alignment with the plane of the fastener tape. The coupling head is pressed at its distal end against the longitudinal beaded edge of the fastener tape to keep the discrete fastener element from getting detached from the longitudinal beaded edge of the fastener tape. Finally, the diverging legs of the fastener element are pressed at their respective outer sides toward each other to clamp the diverging legs to the longitudinal beaded edge of the fastener tape.

3 Claims, 2 Drawing Sheets

METHOD OF ATTACHING FASTENER ELEMENTS TO FASTENER TAPE

BACKGROUND OF THE INVENTION

1. Field of the Invention:

The present invention relates generally to a method of attaching fastener elements to a support tape for slide fasteners or a fastener tape and more particularly to a method of attaching to a longitudinal beaded edge of a fastener tape discrete metal interlocking fastener elements formed beforehand.

2. Description of the Prior Art:

A typical method of attaching discrete metal fastener elements to a longitudinal beaded edge of a fastener tape are disclosed in Japanese Pat. Publication Showa No. 33-8030, U.S. Pat. Nos. 1,903,659 and 2,125,707. In such a conventional method, fastener elements each comprising a coupling head and a pair of diverging legs extending therefrom are fed into the longitudinal beaded edge of the fastener tape and placed astraddle thereof, that is, with one leg on either side thereof. Then, the diverging legs of the fastener element thus disposed on the opposite sides of the fastener tape are squeezed toward each other by means of such as a pair of hammers or punches, so that the fastener element is clamped to the longitudinal beaded edge of the fastener tape. This conventional method, that is, the method of attaching to the fastener tape discrete metal fastener elements formed beforehand is quite advantageous in permitting the entire surface of the metal discrete element to beforehand undergo gold o silver plating or coloring by chemical surface treatment, so that the resultant slide fastener, as a whole, equipped with the thus plated or treated fastener elements is very sightly and attractive in appearance.

However, the above-mentioned conventional method suffers from the following disadvantages. Since the diverging legs of the fastener element are spread widely apart for facilitating placing it astraddle of the longitudinal beaded edge of the fastener tape, the fastener element is liable to incline relative to the plane of the fastener tape when placed astraddle thereof, so that the fastener element would be attached thereto as it remains inclined. This would constitute an obstacle to coupling engagement of fastener elements of the mating fastener stringers, thus preventing smooth reciprocation of a slider along the opposed rows of fastener elements. Furthermore, fastener elements attached as inclined both relative to the plane of fastener tape and relative to one another would make the resultant slide fastener as a whole unsightly or poor in appearance.

SUMMARY OF THE INVENTION

With the foregoing drawbacks in view, it is therefore an object of the present invention to provide a method of attaching metal fastener elements to a longitudinal beaded edge of a fastener tape wherein fastener elements can be fed to astraddle of the longitudinal beaded edge of the fastener tape at great ease.

It is another object of the present invention to provide a method of attaching discrete metal fastener elements to a longitudinal beaded edge of a fastener tape wherein, even if a fastener element were inclined relative to or out of alignment with the plane of the fastener tape when fed to astraddle of the longitudinal beaded edge of the fastener tape, the fastener elements could be rectified in posture into alignment with the plane of the fastener tape, and be firmly attached to the longitudinal beaded edge of the fastener tape in the thus rectified posture.

According to the present invention, there is provided a method of attaching discrete metal fastener elements each including a coupling head and a pair of diverging legs extending therefrom to a fastener tape, the method comprising the steps of: intermittently transferring the fastener tape under tension longitudinally thereof; feeding the discrete metal fastener elements to astraddle of one longitudinal beaded edge of the fastener tape; pressing the coupling head at its opposite sides substantially perpendicularly to the plane of the fastener tape to bring the fastener element into alignment with the plane of the fastener tape; pressing the coupling head at its distal end against the longitudinal beaded edge of the fastener tape to keep the discrete fastener element from getting detached from the longitudinal beaded edge of the fastener tape, and then pressing the diverging legs at their respective outer sides toward each other to clamp the diverging legs to the longitudinal beaded edge of the fastener tape.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
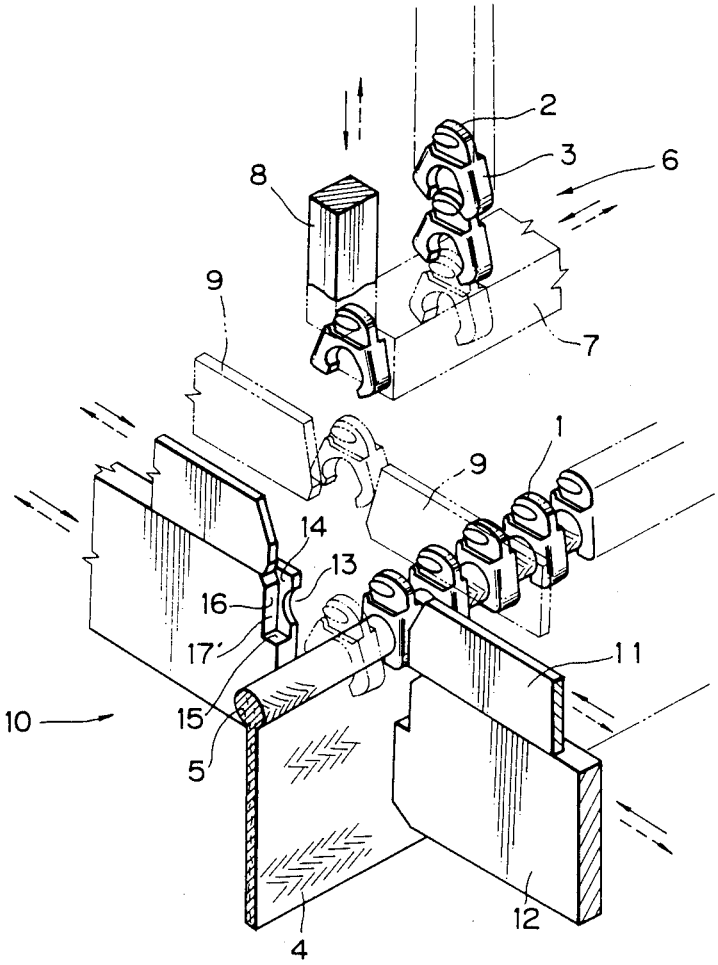
FIG. 1 is a schematic perspective view of part of an apparatus with which a method embodying the present invention is practiced.

FIG. 1 schematically shows part of an apparatus with which a method embodying the present invention is practiced. The apparatus broadly comprises a feeding station 6 for feeding discrete metal fastener elements 1 formed beforehand from any suitable hopper (not shown) and an attaching station 10 for attaching the discrete metal fastener elements 1 fed through the feeding station 6 to a longitudinal beaded edge 5 of a fastener tape 4, both stations 6, 10 operating in timed relation to each other.

Each of the fastener elements 1 generally comprises a coupling head 2 and a pair of diverging legs 3, 3 integrally extending therefrom.

The fastener tape 4 has on and along one longitudinal edge a beaded edge 5 which is substantially circular in cross-section. The fastener tape 4 is intermittently transferred horizontally longitudinally thereof under tension through the attaching station 10 and is disposed vertically with the beaded edge 5 facing upward.

The fastener elements 1 are fed down successively in a row through a chute (not shown) from the hopper (neither shown). As the fastener elements 1 reach the bottom of the chute, they are then pushed intermittently one by one therefrom to the predetermined position right over the attaching station 10 by a feed rod 7 which is reciprocatively movable laterally of the general path of the feeding of the fastener elements 1. In this instance, the diverging legs 3, 3 of each fastener element 1 are directed downward and are spread apart the distance slightly greater than the diameter of a longitudinal beaded edge 5 of the fastener tape 4, as shown in FIG. 1. The moment the fastener element 1 thus pushed by the feed rod 7 has reached the predetermined position right over the attaching station 10, the fastener element 1 falls down by its own weight and then comes into supported engagement with a pair of stoppers 9, 9, resulting in a temporary stop, as better shown in phantom lines in FIG. 1. Since the hopper, the chute, a guide mechanism, and other feeding mechanisms do not constitute the present invention, such parts have been omitted in the drawings for brevity.

The pair of stoppers 9, 9 are movable toward and away from each other perpendicularly to the plane of the fastener tape 4 and are normally urged by suitable biasing means (not shown) toward each other but keep spaced from each other by the distance such that the diverging legs 3, 3 of the falling fastener element 1 are resiliently supported by and between the stoppers 9, 9 at their opposed ends to thus bring the fastener element 1 into a temporary stop.

Then, the fastener element 1 temporarily retained by and between the stoppers 9, 9 is depressed at its coupling head 2 by the pusher rod 8 which is reciprocatively movable vertically by cam means or any other suitable means, whereby the stoppers 9, 9 are spread apart against the bias of the biasing means, thus letting the fastener element 1 fall down through therebetween by its own weight. After released from between the stoppers 9, 9, the fastener element 1 falls into straddling engagement with the longitudinal beaded edge 5 of the fastener tape 4, as shown in phantom lines in FIG. 1. Continued descent of the pusher rod 8 would cause the pusher rod 8 to press the coupling head 2 of the fastener element 1 at its distal end or apex to thus retain the fastener element 1 against the longitudinal beaded edge 5 of the fastener tape 4 against upward detachment therefrom during the attachment of the fastener element 1 thereto.

As shown in FIG. 1, the attaching station 10 generally comprises a pair of aligning plates 11, 11 and a pair of coacting clamping punches 12, 12 positioned right beneath the aligning plates 11, 11. The pair of aligning plates 11, 11 are disposed perpendicularly to and one on each side of the plane of the fastener tape 4 and are reciprocatively movable toward and away from each other perpendicularly to the plane of the fastener tape 4 by cam means or any other suitable means to press the coupling head 2 at its opposite sides to bring the fastener element 1 into alignment with the plane of the fastener tape 4. The pair of clamping punches 12, 12, just likewise, are disposed perpendicularly to and one on each side of the plane of the fastener tape 4 and are reciprocatively movable toward and away from each other perpendicularly to the plane of the fastener tape 4 for pressing the diverging legs 3, 3 of the fastener element 1 at their respective outer sides toward each other to cause the diverging legs 3, 3 to firmly clamp the longitudinal beaded edge 5 of the fastener tape 4.

The clamping punches 12, 12 have a pair of complementary pocket halves 17', 17' at their respective opposed ends to jointly function to receive therein the diverging legs 3 of the fastener element 1 straddling the longitudinal beaded edge 5 of the fastener tape 4. Each of the pocket halves 17', 17' is defined by a bottom surface 15 extending longitudinally of the clamping punch 12, a side surface 16 extending normal to the bottom surface 15 and a rear wall 14 extending integrally and coplanar with the rear surface of the punch 12. The rear wall 14 has a concave notch 13 in the edge facing the longitudinal beaded edge 5 of the fastener tape 4. The pair of complementary pocket halves 17', 17' coact to receive therein the diverging legs 3 of the fastener element 1 sitting astraddle of the longitudinal beaded edge 5 of the fastener tape 4 such that the bottom surfaces 15, 15 of the pocket halves 17', 17' support the respective distal ends of the diverging legs 3, 3 of the fastener element 1 and the opposed side surfaces 16, 16 press the diverging legs 3, 3 at their respective outer sides toward each other to firmly clamp the diverging legs 3, 3 to the longitudinal beaded edge 5 of the fastener tape 4 as shown in FIG. 2(*d*).

Figure 2:
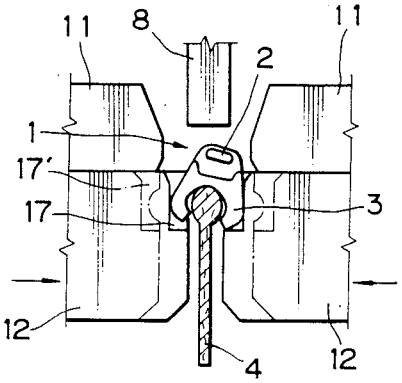
FIGS. 2(*a*), 2(*b*), 2(*c*) and 2(*d*) are front elevational views of the apparatus part of FIG. 1 to show the sequential steps of the method of the present invention.
Figure 2:
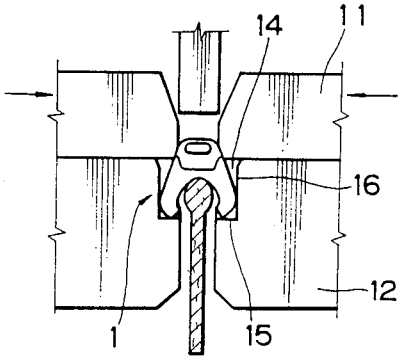
Figure 2:
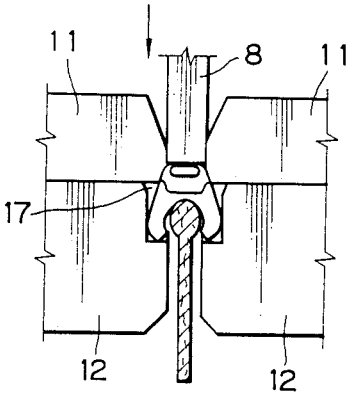
Figure 2:
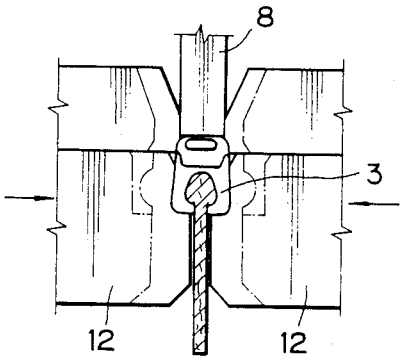

Now, description is made of a method of attaching the fastener elements 1 to the fastener tape 4 according to the present invention in conjunction with the FIGS. 2(*a*) through 2(*d*).

Before starting the attaching operation, the pusher rod 8, the aligning plates 11, 11 and clamping punches 12, 12 all assume their respective retracted positions, as shown in FIG. 1. First, the clamping punches 12, 12 move toward each other from the position indicated in the phantom lines to that indicated in the solid lines in FIG. 2(*a*), to thus define therebetween the pocket 17 through the combination of pocket halves 17', 17'. Then, the pusher rod 8 descends to depress the coupling head 2 of the fastener element 1 held in temporary stop by the stoppers 9, 9 to thus cause the stoppers 9, 9 to spread widely apart, thereby letting the fastener element 1 fall down through therebetween by its own weight. After thus released from the stoppers 9, 9, the fastener element 1 falls into straddling engagement with the longitudinal beaded edge 5 of the fastener tape 4, with the diverging legs 3, 3 of the fastener element 1 supported at their distal ends by the bottom surfaces 15, 15 of the complementary pocket halves 17', 17'. Since the diverging legs 3, 3 are spread apart widely for facilitating straddle by the fastener element 1 of the longitudinal beaded edge 5 of the fastener tape 4, the fastener element 1 is liable to incline relative to the plane of the fastener tape 4, as better shown in FIG. 2(*a*). In order to rectify the inclined posture of the fastener element 1, aligning plates 11, 11 move toward each other to thus press the coupling head 2 at its both sides to thereby bring and keep the fastener element 1 into and in alignment with the plane of the fastener tape 4, as shown in FIG. 2(*b*). Throughout the aligning operation of the inclined fastener element 1 by the aligning plates 11, 11, the pusher rod 8 remains retracted out of engagement with the coupling head 2 of the fastener element 1 for facilitating the aligning operation. After the completion of the alignment operation, the pusher rod 8 descends and presses the distal end of the coupling head 2 against the longitudinal beaded edge 5 of the fastener tape 4 to thus prevent the fastener element 1 against accidental upward displacement therefrom during the clamping of the fastener element 1 to the longitudinal beaded edge 5 of the fastener tape 4 by the clamping punches 12, 12, as shown in FIG. 2(*c*). While the coupling head 2 of the fastener element 1 is thus retained at its opposed sides by the aligning plates 11, 11 and at its distal end by the pusher rod 8, the clamping punches 12, 12 move toward each other perpendicularly to the plane of the fastener tape 4 and press the diverging legs 3, 3 at their respective outer sides toward each other to thus clamp the diverging legs 3, 3 to the longitudinal beaded edge 5 of the fastener tape 4, as shown in FIG. 2(*d*). It is to be noted that, before and during the clamping- operation of the diverging legs 3, 3 of the fastener element 1 to the longitudinal beaded edge 5 of the fastener tape 4 by the clamping punches 12, 12; the rear walls 14, 14 provided at the opposed ends of the clamping punches 12, 12 come between the fastener element 1 to be just clamped and the preceding fastener element to thus grippingly retain that portion of the longitudinal beaded edge 5 interposed therebetween at their concave notches 13, 13 against accidental displacement or detachment of the fastener tape 4, so that the fastener element 1 can be secured to the longitudinal beaded edge 5 of the fastener tape 4 accurately and reliably.

After the attachment of the fastener element 1 to the longitudinal beaded edge 5 of the fastener tape 4 has been completed, the aligning plates 11, 11, clamping punches 12, 12 and pusher rod 8 are restored into their respective retracted positions. Then, the fastener tape 4 is transferred along the path of transfer by one interelement pitch for attachment of the ensuing fastener element thereto. As these steps are repeatedly followed, discrete metal fastener elements 1 will be progressively attached to the longitudinal beaded edge 5 of the fastener tape 4.

Although, in the foregoing embodiment, the fastener element 1 is fed horizontally from the bottom of the chute to the predetermined position right above the attaching station 10 by means of the feed rod 7; instead, the bottom of the chute may be positioned right above the attaching position 10 so that fastener elements 1 may be supplied directly to right above the attaching station 10, in which instance, a detent or any like device is provided in adjacency to the bottom of the chute in such a way to swing into and out of engagement with the bottom of the chute to feed the fastener element 1 one by one to astraddle of the longitudinal beaded edge 5 of the fastener tape 4.

Still alternatively, instead of being transferred horizontally longitudinally thereof, the fastener tape 4 may be transferred vertically longitudinally thereof. In this instance, since it is naturally impossible to feed the fastener elements 1 by its own gravity, the pusher rod 8 is reciprocative horizontally toward and away from the vertically disposed longitudinal beaded edge 5 of the fastener tape 4 to play a role to horizontally feed the fastener element 1 to astraddle of the longitudinal beaded edge 5 of the fastener tape 4.

In the foregoing embodiment, the coupling head 2 of the metal discrete fastener element 1 which undergoes the method according to the present invention is shown to include a pair of opposed upper and lower coupling convex projections which are symmetrically disposed to each other across the plane of the fastener element 1. However, the method according to the present invention may be similarly applicable to metal discrete fastener elements of any other configuration, for example, a fastener element having a coupling head including a convex projection on its one side and a concave recess in the other side for engagement with a concave projection on an adjacent element on the mating fastener tape.

The method according to the present invention being such that, the following advantages have been enjoyed. Even if the fastener element were placed astraddle of the longitudinal beaded edge in inclined manner, the fastener element could be brought into alignment with the plane of fastener tape, that is, it could be rectified in posture, at great ease. Therefore, the fastener elements can be attached to the longitudinal beaded edge of the fastener tape always in proper alignment with the plane of the fastener tape.

Still furthermore, the rate of the attaching operation has been increased greatly.

Obviously, various modifications and variations of the present invention are possible in the light of the above teaching. It is therefore to be understood that within the scope of the appended claims the invention may be practiced otherwise than as specifically described.

What is claimed is:

1. A method of attaching discrete metal fastener elements, each including a coupling head and a pair of diverging legs extending therefrom, to a fastener tape, said method comprising the following steps:

intermittently transferring the fastener tape under tension longitudinally thereof;

feeding a discrete metal fastener element to a position astraddle a longitudinal beaded edge of said fastener tape;

pressing the coupling head of said discrete metal fastener element, at a distal end thereof, against said longitudinal beaded edge to inhibit detachment of said fastener element from said beaded edge;

pressing said coupling head, at opposite sides thereof substantially perpendiculary to a plane co-extensive with said fastener tape, to bring said fastener element into predetermined alignment with said plane; and subsequent to said steps of pressing said coupling head, pressing the diverging legs of said fastener element towards each other to clamp the diverging legs to said longitudinal beaded edge.

2. A method of attaching discrete metal fastener elements to a fastener tape according to claim 1, the fastener tape being fed horizontally as disposed vertically with the longitudinal beaded edge thereof facing upward, the discrete metal fastener element being fed vertically to astraddle of the longitudinal edge of the fastener tape by its own weight.

3. A method of attaching discrete metal fastener elements to a fastener tape according to claim 1, the fastener tape being transferred vertically, the discrete metal fastener element being fed horizontally to astraddle of the longitudinal edge of the fastener tape.

* * * * *